US011118275B2

(12) United States Patent
Fritz et al.

(10) Patent No.: US 11,118,275 B2
(45) Date of Patent: Sep. 14, 2021

(54) SELF-CLEANING SYSTEM AND METHOD OF CLEANING ELECTROLYTIC CELLS

(71) Applicant: UGSI Solutions, Inc., Poway, CA (US)

(72) Inventors: Billie Fritz, Fremont, CA (US); Brent A. Simmons, Palo Alto, CA (US)

(73) Assignee: UGSI Solutions, Inc., Poway, CA (US)

( * ) Notice: Subject to any disclaimer, the term of this patent is extended or adjusted under 35 U.S.C. 154(b) by 75 days.

(21) Appl. No.: 16/549,575

(22) Filed: Aug. 23, 2019

(65) Prior Publication Data

US 2020/0063277 A1 Feb. 27, 2020

Related U.S. Application Data

(60) Provisional application No. 62/722,479, filed on Aug. 24, 2018.

(51) Int. Cl.

| | |
|---|---|
| ***B08B 5/02*** | (2006.01) |
| ***C25B 15/00*** | (2006.01) |
| ***C25B 9/70*** | (2021.01) |

(52) U.S. Cl.

CPC ..... *C25B 15/00* (2013.01); *B08B 5/02* (2013.01); *C25B 9/70* (2021.01)

(58) Field of Classification Search

CPC ..... C25B 15/00; C25B 9/70; B08B 5/02

See application file for complete search history.

(56) References Cited

U.S. PATENT DOCUMENTS

| | | | | |
|---|---|---|---|---|
| 3,706,646 | A | 12/1972 | Gibson, Jr. et al. | |
| 4,470,891 | A * | 9/1984 | Moore | C01D 3/14 205/536 |
| 5,112,464 | A * | 5/1992 | Tsou | C25B 15/08 204/230.2 |
| 5,676,823 | A | 10/1997 | McKay et al. | |
| 7,897,022 | B2 | 3/2011 | Simmons et al. | |
| 2007/0251828 | A1 | 11/2007 | Grazier et al. | |
| 2015/0071575 | A1 | 3/2015 | Galliher et al. | |
| 2020/0063277 | A1 * | 2/2020 | Fritz | C25B 9/70 |

OTHER PUBLICATIONS

Written Opinion and Search Report for PCT/US2019/047838 (dated Year: 2019).*

* cited by examiner

*Primary Examiner* — Sharidan Carrillo
(74) *Attorney, Agent, or Firm* — The Webb Law Firm

(57) ABSTRACT

The present invention relates to a method of cleaning electrolytic cells that includes: (a) directing a base solution comprising water into an array of electrolytic cells; and (b) removing contaminants from at least one of the electrolytic cells with air turbulence provided by an injection of compressed air into the electrolytic cell. The injection of compressed air is provided by an air sparging system in fluid communication with an inlet portion of the at least one electrolytic cell. A self-cleaning electrolytic cell system is further included.

9 Claims, 4 Drawing Sheets

SELF-CLEANING SYSTEM AND METHOD OF CLEANING ELECTROLYTIC CELLS

This application is based on U.S. Provisional Application No. 62/722,479, filed Aug. 24, 2018, on which priority of this patent application is based and which is incorporated herein by reference in its entirety.

BACKGROUND OF THE INVENTION

Field of the Invention

The present invention is generally directed to a self-cleaning system and method of cleaning electrolytic cells.

Description of Related Art

Water utilities that use on-site electrolytic cells for generation of sodium hypochlorite or bleach face ongoing challenges associated with the need for soft water to feed the generation systems. For instance, on-site systems are typically vulnerable to contaminants such as calcium, magnesium, iron, and manganese in the raw water supply or salt brine, which is the chloride feed stock to the generation system.

Currently, there are two primary mechanisms for softening water. First, and most common, is conventional ion exchange systems where a zeolite media attracts sodium ions from a concentrated brine solution. When placed in operation, the sodium ion is exchanged for the various cations previously described. However, this mechanism requires a sanitary sewer connection that is not typically available at smaller utility facilities such as well-head treatment or storage reservoirs.

A second mechanism for softening water uses remotely recharged ion exchange bottles that are swapped out every few weeks and returned to an outside vendor to be recharged. While this mechanism works well to soften water, it is very costly and labor intensive.

Thus, it is desirable to provide a system and method for cleaning electrolytic cells such that water softening is not required.

SUMMARY OF THE INVENTION

In certain non-limiting embodiments or aspects, provided is a method of cleaning electrolytic cells comprising: (a) directing a base solution comprising water into an array of electrolytic cells; and (b) removing contaminants from at least one of the electrolytic cells with air turbulence provided by an injection of compressed air into the electrolytic cell. The injection of compressed air is provided by an air sparging system in fluid communication with an inlet portion of the at least one electrolytic cell. Further, contaminants are removed from each of the electrolytic cells by an injection of compressed air when the air sparging system is in fluid communication with inlet portions of each of the electrolytic cells. The contaminants that are removed can comprise crystals formed from cations.

In certain non-limiting embodiments, the air sparging system comprises an air compressor, a control valve, and an air distribution line in fluid communication with the inlet portion of the at least one electrolytic cell. The control valve can comprise a solenoid that includes an air supply inlet in fluid communication with the air compressor and at least one air outlet in fluid communication with the air distribution line.

In some non-limiting embodiments, a controller is in operable communication with the air sparging system, and one or more computer-readable storage mediums are in operable communication with the controller. The one or more computer-readable storage mediums can contain programming instructions that, when executed, cause the controller to inject compressed air into the at least one electrolytic cell at a pre-determined duration.

In some non-limiting embodiments, the method further comprises directing the base solution through a catalytic bed where cations in the base solution are transformed into crystals prior to step (a). The formed crystals can be removed from the array of electrolytic cells by the injection of compressed air.

In certain non-limiting embodiments, the present invention is also directed to a self-cleaning electrolytic cell system comprising: an array of electrolytic cells in fluid communication with each other; and an air sparging system in fluid communication with an inlet portion of at least one electrolytic cell that is configured to inject compressed air into the at least one electrolytic cell. The air sparging system can also be in fluid communication with inlet portions of each of the electrolytic cells.

In some non-limiting embodiments, the air sparging system comprises an air compressor, a control valve, and an air distribution line in fluid communication with the inlet portion of the at least one electrolytic cell. In certain non-limiting embodiments, the control valve comprises a solenoid valve. The solenoid valve can comprise an air supply inlet in fluid communication with the air compressor and at least one air outlet in fluid communication with the air distribution line. The solenoid valve can also comprise a plurality of air outlets in fluid communication with a plurality of air distribution lines in fluid communication with separate electrolytic cells.

In certain non-limiting embodiments, the system further comprises a controller in operable communication with the air sparging system, and one or more computer-readable storage mediums in operable communication with the controller. In addition, a frame can be used to hold the array of electrolytic cells, and the control valve of the air sparging system can be attached to the frame.

In certain non-limiting embodiments, the system further comprises a base solution contained in a vessel that is in fluid communication with the array of electrolytic cells. The system can also comprise a check valve positioned between the control valve and an area where air enters the inlet portion of the at least one electrolytic cell and/or a catalytic bed in fluid communication with the array of electrolytic cells.

Additional preferred and non-limiting embodiments or aspects are set forth and described in the following clauses.

Clause 1: A method of cleaning electrolytic cells comprising: (a) directing a base solution comprising water into an array of electrolytic cells; and (b) removing contaminants from at least one of the electrolytic cells with air turbulence provided by an injection of compressed air into the electrolytic cell, wherein the injection of compressed air is provided by an air sparging system in fluid communication with an inlet portion of the at least one electrolytic cell.

Clause 2: The method of clause 1, wherein contaminants are removed from each of the electrolytic cells by an injection of compressed air and the air sparging system is in fluid communication with inlet portions of each of the electrolytic cells.

Clause 3: The method of any of clauses 1 or 2, wherein the air sparging system comprises an air compressor, a control valve, and an air distribution line in fluid communication with the inlet portion of the at least one electrolytic cell.

Clause 4: The method of clause 3, wherein the control valve comprises a solenoid valve.

Clause 5: The method of clause 4, wherein the solenoid valve comprises an air supply inlet in fluid communication with the air compressor and at least one air outlet in fluid communication with the air distribution line.

Clause 6: The method of any of clauses 1-5, wherein a controller is in operable communication with the air sparging system, and one or more computer-readable storage mediums are in operable communication with the controller.

Clause 7: The method of clause 6, wherein the one or more computer-readable storage mediums contain programming instructions that, when executed, cause the controller to inject compressed air into the at least one electrolytic cell at a pre-determined duration.

Clause 8: The method of any of clauses 1-6, wherein the contaminants comprise crystals formed from cations.

Clause 9: The method of any of clauses 1-8, further comprising directing the base solution through a catalytic bed where cations in the base solution are transformed into crystals prior to step (a).

Clause 10: The method of clause 9, wherein the crystals are removed from the array of electrolytic cells by the injection of compressed air.

Clause 11: A self-cleaning electrolytic cell system comprising: an array of electrolytic cells in fluid communication with each other; and an air sparging system in fluid communication with an inlet portion of at least one electrolytic cell that is configured to inject compressed air into the at least one electrolytic cell.

Clause 12: The system of clause 11, wherein the air sparging system is in fluid communication with inlet portions of each of the electrolytic cells.

Clause 13: The system of any of clauses 11 or 12, wherein the air sparging system comprises an air compressor, a control valve, and an air distribution line in fluid communication with the inlet portion of the at least one electrolytic cell.

Clause 14: The system of clause 13, wherein the control valve comprises a solenoid valve.

Clause 15: The system of clause 14, wherein the solenoid valve comprises an air supply inlet in fluid communication with the air compressor and at least one air outlet in fluid communication with the air distribution line.

Clause 16: The system of clause 14, wherein the solenoid valve comprises a plurality of air outlets in fluid communication with a plurality of air distribution lines in fluid communication with separate electrolytic cells.

Clause 17: The system of any one of clauses 11-16, further comprising a controller in operable communication with the air sparging system, and one or more computer-readable storage mediums in operable communication with the controller.

Clause 18: The system of any of clauses 13-17, further comprising a frame that holds the array of electrolytic cells, and wherein the control valve of the air sparging system is attached to the frame.

Clause 19: The system of any of clauses 11-18, further comprising a base solution contained in a vessel that is in fluid communication with the array of electrolytic cells.

Clause 20: The system of any of clauses 11-19, further comprising a check valve positioned between the control valve and an area where air enters the inlet portion of the at least one electrolytic cell.

Clause 21: The system of any of clauses 11-20, further comprising a catalytic bed in fluid communication with the array of electrolytic cells.

DETAILED DESCRIPTION OF THE INVENTION

Figure 1:
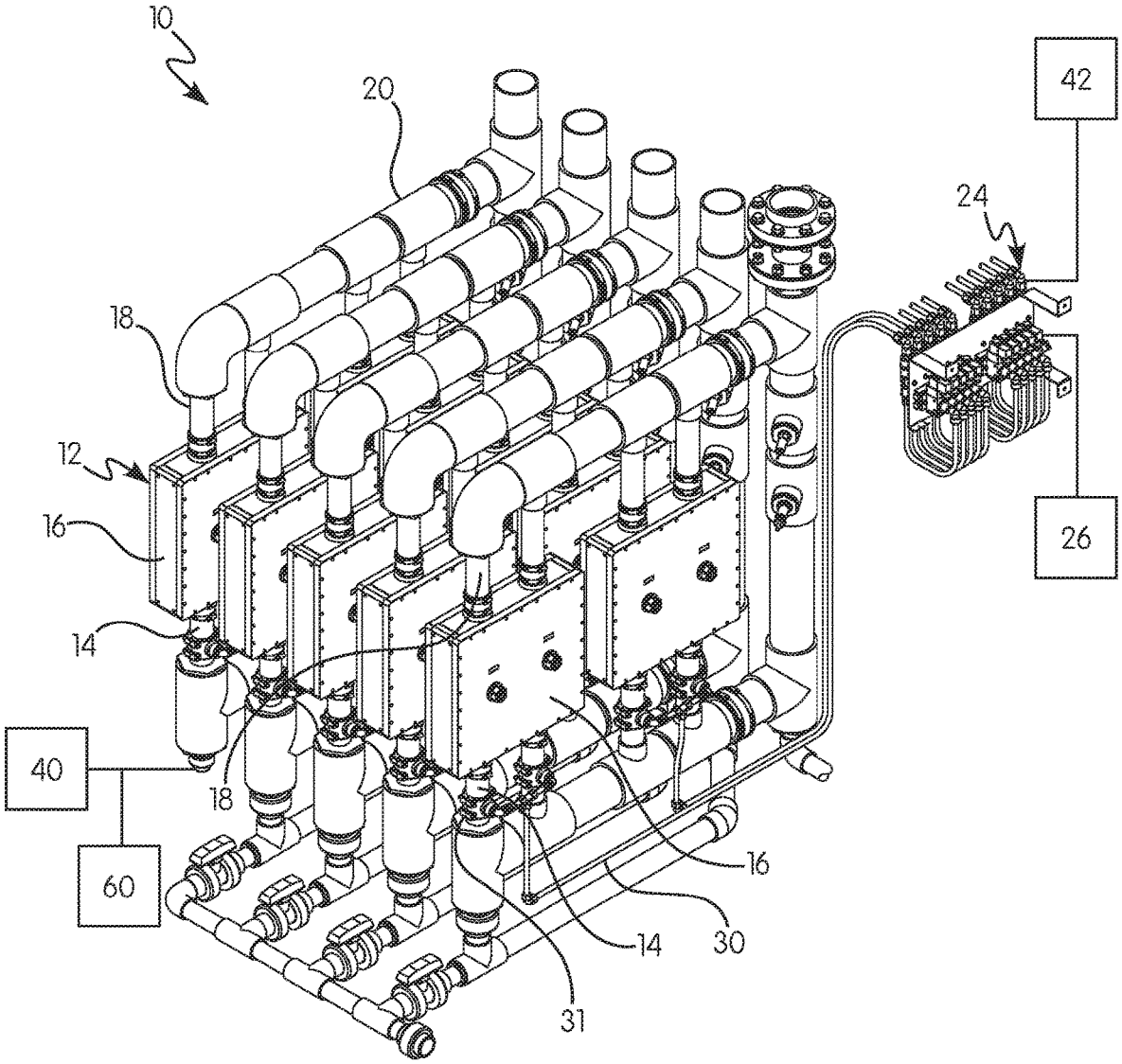
FIG. 1 illustrates a perspective view of an array of electrolytic cells having a sparging system according to the principles of the present invention.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Further, the terms "upper," "lower," "right," "left," "vertical," "horizontal," "top," "bottom," "lateral," "longitudinal," and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the specification, are simply exemplary embodiments of the invention. Hence, specific dimensions and other physical characteristics related to the embodiments disclosed herein are not to be considered as limiting.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Referring to FIG. 1, and in one preferred and non-limiting embodiment, the present invention is directed to a self-cleaning electrolytic cell system 10. As used herein, "self-cleaning", with respect to the present invention, refers to the capability of the system 10 to clean one or more electrolytic cells 12 without substantial participation of a human operator in normal operations manually controlling the controllable components. It is appreciated that the system 10 is configured to liberate hydrogen from a base or brine solution. For example, the system 10 can be used to form sodium hypochlorite by liberating hydrogen from a base or brine solution of salt and water.

As shown in FIG. 1, the system 10 includes an array or plurality of electrolytic cells 12 connected in a series in fluid communication with each other. Any number of electrolytic cells 12 may be used such as to generate the desired amount of chemical. For instance, the number of electrolytic cells 12 can be selected to generate a desired amount of sodium hypochlorite per day. The array of electrolytic cells 12 is configured to be modular, such that a minimum of one cell 12 may be used for lower duty applications, and additional cells 12 may be readily added to increase output.

As further shown in FIG. 1, each electrolytic cell 12 comprises an inlet 14, a cell body 16, and an outlet 18. The inlet 14 of each electrolytic cell 12 allows materials and, in particular, a liquid solution to enter the cell body 16. After entering the cell body 16, the liquid solution passes through a plurality of bipolar electrode plates. As the liquid solution passes through the electrolytic cell 12, current is applied by the plates such that hydrogen is liberated from the solution. The treated liquid solution then exits the cell body 16 through the outlet 18.

The electrolytic cells 12 can be fluidly connected using various transfer lines 20. Such transfer means include, but are not limited to, junctions and bifurcated lines. A non-limiting example of suitable electrolytic cells 12 with such transfer lines that can be used with the water treatment system 10 as described in U.S. Pat. No. 7,897,022 at least in column 7, line 6 to column 11, line 41 and the corresponding figures, which is incorporated by reference herein. For example, and as described in U.S. Pat. No. 7,897,022, when sodium hypochlorite is formed, the junction allows density differentials between the sodium hypochlorite and the hydrogen to passively separate into different dedicated bifurcated lines. The modified solution (containing a small percentage of sodium hypochlorite) is directed down a return line, while the hydrogen vents vertically out a second line to output. The return line reaches a second junction, wherein a portion of the modified solution is cycled back through the electrolytic cell 12, and another portion of the modified solution is directed through a smaller feed tube to the inlet 14 of the second electrolytic cell 12 of the series. The process is repeated until the solution has passed through all the electrolytic cells 12 and into an electrolytic cell 12 outlet line 18. After processing, the sodium hypochlorite can be transferred into a vessel or other containment means.

The electrolytic cells 12 passively allow all produced hydrogen to be removed from each electrolytic cell 12 by the density differential created during the electrolytic process. In certain non-limiting embodiments, the electrolytic cells 12 are vertically aligned hydraulically in a series. The vertical orientation and configuration of the electrolytic cells 12 allows for the instantaneous passive removal of hydrogen produced.

Referring to FIG. 1, and in accordance with the present invention, the system 10 further includes an air sparging system 24 in fluid communication with an inlet 14 portion of at least one electrolytic cell 12. The air sparging system 24 is configured to inject compressed air into the inlet 14 of at least one electrolytic cell 12 to remove contaminants found within the electrolytic cell 12 such as crystals formed from cations in the base solution. In some non-limiting embodiments, the air sparging system 24 is in fluid communication with inlet 14 portions of all the electrolytic cells 12 and, therefore, is configured to inject compressed air into the inlets 14 of all the electrolytic cells 12.

In certain non-limiting embodiments, and as shown in FIG. 1, the air sparging system 24 comprises an air compressor 26, a control valve 28, and an air distribution line 30. The air compressor 26 is in fluid communication with the control valve 28 and can include various types of air compressors capable of distributing air into the control valve 28. Further, the air distribution line 30 is in fluid communication with both the control valve 28 and the inlet 14 portion of the at least one electrolytic cell 12. The air distribution line 30 can be connected to one or more areas at the inlet 14 portion of the electrolytic cell 12. For instance, and as shown in FIG. 2, air can be injected into one or more injection points 31 at the inlet 14 portion of the electrolytic cell 12 such as into an inlet pipe of the electrolytic cell 12.

Figure 2:
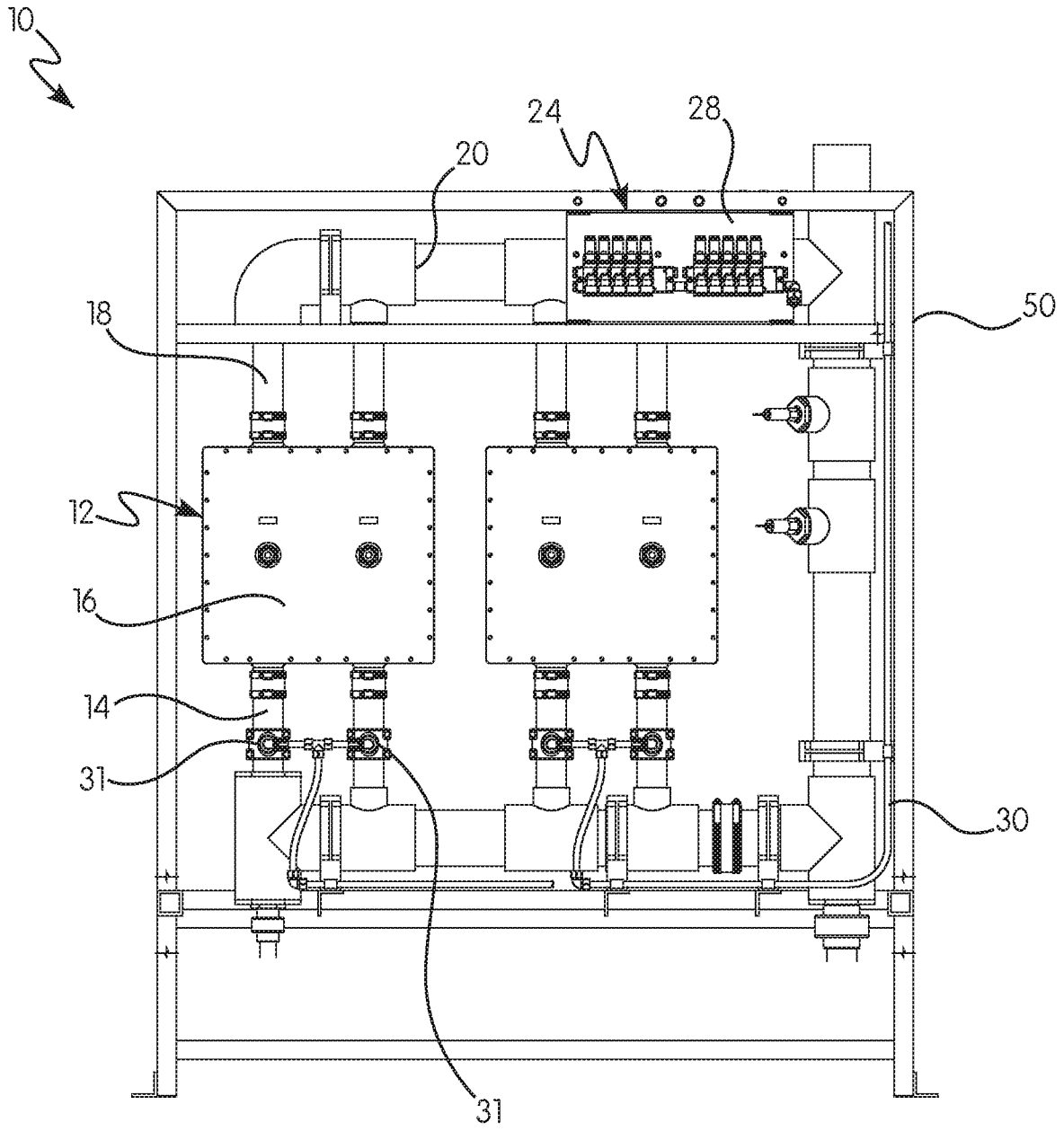
FIG. 2 illustrates a side view of an array of electrolytic cells having a sparging system according to the principles of the present invention.

In some non-limiting embodiments, as shown in FIGS. 1 and 2, the air sparging system 24 includes multiple air distribution lines 30 that are in fluid communication with each of the inlet 14 portions of the electrolytic cells 12. In such embodiments, the air sparging system 24 distributes compressed air to each of the electrolytic cells 12.

Figure 3:
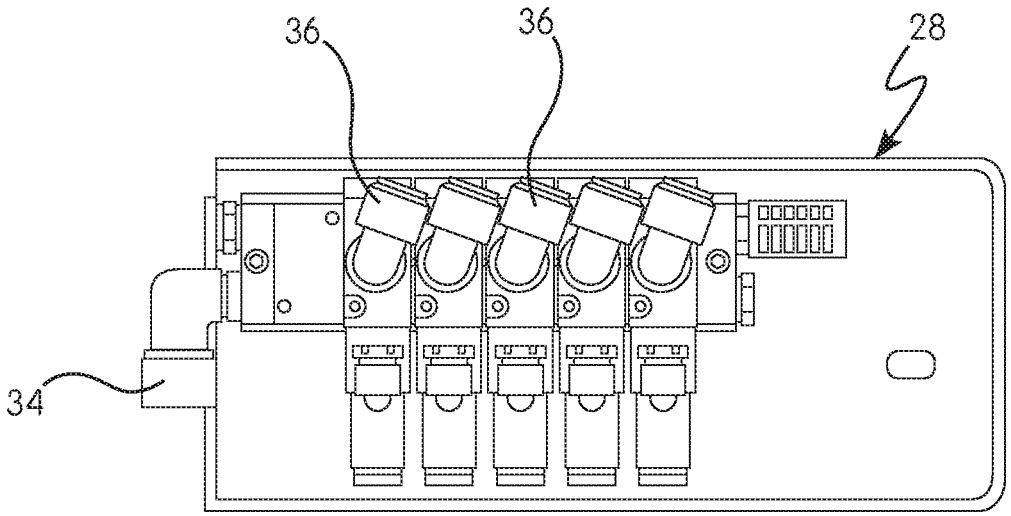
FIG. 3 is a perspective view of a control device of a sparging system according to the principles of the present invention.

In certain non-limiting embodiments, and as shown in FIG. 3, the control valve 28 is a solenoid valve. For example, the control valve 28 can include an air solenoid valve that controls the distribution of air. In some non-limiting embodiments, the control valve 28 includes air inlet 34 for receiving air from the air compressor 26 and at least one or multiple air outlets 36 that are connected to the air distribution lines 30. The air distribution lines 30 extend from the air outlets 36 of the control valve 28 to the various electrolytic cells 12.

Referring to FIG. 1, in some non-limiting embodiments, the system 10 further includes one or more vessels 40 that store a base or brine solution. The one or more vessels 40 are in fluid communication with one or more of the previously described electrolytic cells 12 to distribute the solution into the array of the electrolytic cells 12.

The system 10 can also include a controller 42 in operable communication with the air sparging system 24, and one or more computer-readable storage mediums in operable communication with the controller 42. The controller 42 can be used to automatically operate the air sparging system 24 and, optionally, other processes of the system 10. For example, the computer-readable storage mediums can contain programming instructions that, when executed, cause the controller 42 to perform multiple tasks including, but not limited to, controlling the amount and duration of air distributed into the electrolytic cells 12 from the air sparging system 24. It is appreciated that the controller 42 may include one or more microprocessors, CPUs, and/or other computing devices.

Referring to FIG. 2, in some non-limiting embodiments, the system 10 includes a frame 50 that holds and retains the array of electrolytic cells 12. In such embodiments, the control valve 28 can be attached to the frame 50. It is appreciated that the control valve 28 and other components of the air sparging system 24 can be placed in various areas provided that compressed air is adequately distributed into the array of electrolytic cells 12.

As shown in FIG. 1, and in some non-limiting embodiments, the system 10 further includes a catalytic bed 60 in fluid communication with the array of electrolytic cells 12. In certain non-limiting embodiments, the catalytic bed 60 is in fluid communication with both the array of electrolytic cells 12 and the one or more vessels 40 that store a base or brine solution such that the solution enters the catalytic bed before entering the electrolytic cells 12. The catalytic bed 60 causes a change in the physical state of the cations into crystals before entering the electrolytic cells 12. The catalytic bed 60 causes a change in the physical state of reactive cations into inert suspensions before entering the electrolytic cells 12. For instance, reactive calcium bicarbonate molecules become a carbon dioxide/calcium carbonate suspension, which then passes through the electrolytic cells 12 unreacted (as opposed to scaling the cells, necessitating maintenance). The catalytic beds 60 are also referred to as "Nucleation Assisted Crystallization" or "NAC".

Figure 4:
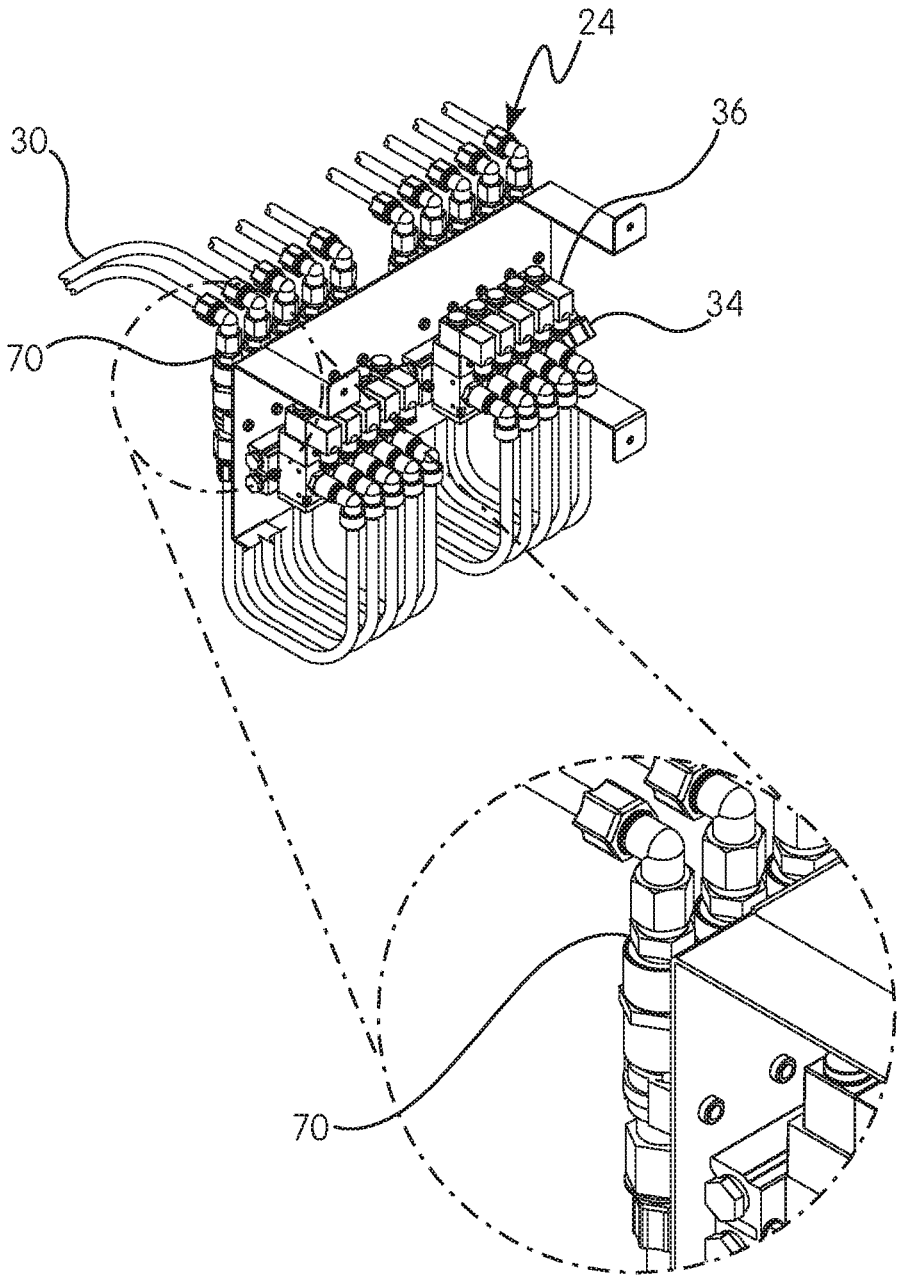
FIG. 4 is a perspective view and exploded view of a sparging system according to the principles of the present invention.

In certain non-limiting embodiments, as shown in FIG. 4, a check valve 70 is positioned in between conduits, such as tubing, that form the air distribution lines 30. When multiple air outlets 36 are used to distribute air to the electrolytic cells 12, a check valve 70 can be used with each distribution line 30 that distributes air to each of the electrolytic cells 12. The check valves 70 prevent materials from back washing into the air distribution lines 30.

The present invention is also directed to a method of cleaning electrolytic cells 12. In certain non-limiting embodiments, the method includes directing a base solution into an array of electrolytic cells 12 and removing contaminants from at least one of the electrolytic cells 12 with air turbulence provided by an injection of compressed air into the electrolytic cell 12. The injection of compressed air is provided by any of the previously described air sparging systems 24. The method can also use any of other previously described components such as the vessels 40 of base or brine solution, controller 42, frame 50, catalytic bed 60, and/or check valves 70.

During operation, compressed air is distributed from the air compressor 26, through the control valve 28, and into the electrolytic cell 12 through the air distribution line(s) 30 where the air is dispersed into the electrolytic cell 12. Contaminants are removed from the electrolytic cells 12 by the compressed air. When a catalytic bed 60 is used, the method can further include directing the base solution through a catalytic bed 60 where cations in the base solution are transformed into crystals prior to entering the electrolytic cells 12. The compressed air can then be used to remove the crystals from the electrolytic cells 12.

In some non-limiting embodiments, the controller 42 is used to control at least the distribution of air into the electrolytic cells 12. For instance, in certain non-limiting embodiments, one or more computer-readable storage mediums contain programming instructions that, when executed, cause the controller 42 to inject compressed air into the at least one electrolytic cell 12 at a pre-determined duration and/or frequency.

It was found that the system 10 and method of the present invention allow for the removal of cation deposition from electrolytic cells 12 at the microscopic level, thereby keeping the cells 12 clean and functional without an auxiliary softening system.

Whereas particular embodiments of this invention have been described above for purposes of illustration, it will be evident to those skilled in the art that numerous variations of the details of the present invention may be made without departing from the invention as defined in the appended claims.

The invention claimed is:

1. A method of cleaning electrolytic cells comprising:

(a) directing a base solution comprising water and salt through a catalytic bed where cations in the base solution are transformed into crystals;

(b) directing the base solution from the catalytic bed and into an array of electrolytic cells; and (c) removing contaminants from at least one electrolytic cell from the array of electrolytic cells with air turbulence provided by an injection of compressed air into the at least one electrolytic cell, wherein the injection of compressed air is provided by an air sparging system in fluid communication with an inlet portion of the at least one electrolytic cell.

2. The method of claim 1, wherein the contaminants are removed from each electrolytic cell from the array of electrolytic cells the by the injection of the compressed air and the air sparging system is in fluid communication with inlet portions of each electrolytic cell from the array of electrolytic cells.

3. The method of claim 1, wherein the air sparging system comprises an air compressor, a control valve, and an air distribution line in fluid communication with the inlet portion of the at least one electrolytic cell.

4. The method of claim 1, wherein a controller is in operable communication with the air sparging system, and one or more computer-readable storage mediums are in operable communication with the controller.

5. The method of claim 1, wherein the contaminants comprise the crystals formed from the cations.

6. The method of claim 1, wherein the crystals are removed from the array of electrolytic cells by the injection of compressed air.

7. The method of claim 3, wherein the control valve comprises a solenoid valve.

8. The method of claim 4, wherein the one or more computer-readable storage mediums contain programming instructions that, when executed, cause the controller to inject compressed air into the at least one electrolytic cell at a pre-determined duration.

9. The method of claim 7, wherein the solenoid valve comprises an air supply inlet in fluid communication with the air compressor and at least one air outlet in fluid communication with the air distribution line.

* * * * *